US006312302B1

(12) United States Patent
Na

(10) Patent No.: US 6,312,302 B1
(45) Date of Patent: Nov. 6, 2001

(54) MANUFACTURING METHOD FOR A FLAT PANEL DISPLAY AND THE DISPLAY WITH REINFORCED SUPPORT SPACERS

(75) Inventor: Yang-woon Na, Suwon-si (KR)

(73) Assignee: Samsung Display Devices Co., Ltd., Kyungki-do (KR)

( * ) Notice: Subject to any disclaimer, the term of this patent is extended or adjusted under 35 U.S.C. 154(b) by 0 days.

(21) Appl. No.: 09/324,904

(22) Filed: Jun. 2, 1999

(30) Foreign Application Priority Data

Jun. 2, 1998 (KR) ..... 98-20366
Apr. 22, 1999 (KR) ..... 99-14473

(51) Int. Cl.[7] ..... H01J 9/24
(52) U.S. Cl. ..... 445/24

(58) Field of Search ..... 445/24; 313/422

(56) References Cited

U.S. PATENT DOCUMENTS 5,649,847 7/1997 Haven ..... 445/24
5,980,346 * 11/1999 Anderson et al. ..... 445/24

* cited by examiner

*Primary Examiner*—Kenneth J. Ramsey
(74) *Attorney, Agent, or Firm*—Christie, Parker & Hale, LLP

(57) ABSTRACT

A faceplate of a flat panel display has spacer-insert grooves. One end-side portions of spacers are fixed in the spacer-insert are formed on the substrate of the faceplate in a predetermined pattern. The faceplate with spacer-insert grooves enhances structural support and alignment of the spacers.

9 Claims, 9 Drawing Sheets

MANUFACTURING METHOD FOR A FLAT PANEL DISPLAY AND THE DISPLAY WITH REINFORCED SUPPORT SPACERS

CROSS-REFERENCES TO RELATED APPLICATIONS

This application is based on application Nos. 98-20366 and 99-14473 filed in the Korean Industrial Property Office on Jun. 2, 1998 and Apr. 22, 1999 respectively, the content of which is incorporated herein by reference.

BACKGROUND OF THE INVENTION

1. Field of the Invention

The invention relates to a flat panel display having a faceplate, particularly to a method for making the faceplate in the flat panel display, wherein the faceplate is formed by inserting into the faceplate spacers for holding the cell gap of the flat panel display at a uniform distance.

2. Description of the Related Art

Proposed is a flat panel display having spacers positioned between both substrates for maintaining a uniform cell-gap of the display.

With the Field Emission Display (FED) technology, the function of the spacers is especially important because the uniformity of the distance of space formed between the faceplate and the backplate by the spacers greatly increases the uniformity of picture quality.

Since the space, in a field emission display, formed between the two substrates is held at a vacuum of $10^{-7}$ torr, the pressure difference imposed by ambient atmospheric pressure on the flat panel display substrates makes it difficult to maintain a uniform distance between these substrates. In other words, it is more difficult to maintain a constant distance in a flat panel display cell gap of a field emission display than in other displays.

Therefore, in flat panel displays such as field emission displays, spacers are of increasing importance as the size of the displays increases.

The spacer should usually have nonconductive characteristics to prevent electrical breakdown between the anode and cathode arrays, sufficient mechanical strength to prevent the collapse of the flat panel display under ambient atmospheric pressure, stability under electron-impact, and the capacity to withstand the high temperatures (of approximately 400° C.) required to keep the inner space formed between both substrates under a high vacuum. The spacers are further characterized in that their width should be narrow, so that the spacers are not recognizable on the display screen.

In U.S. Pat. No. 5,649,847 a conventional type of flat panel display with the above characteristics in consideration is presented, the display comprising an field emission device completed by fitting one end-side portion of a spacer wall into a gripper formed on the faceplate.

The method disclosed in U.S. Pat. No. 5,649,847 concerns forming a spacer, wherein the aforesaid gripper is formed in the faceplate of field emission device first and then one end-side portion of the spacer is inserted into the formed gripper.

However, in the case when the gripper made for the spacer is poorly formed due to inconsistent layer application during a manufacturing stage, wherein a multi-layer application of gripper-forming material is performed, the alignment of the spacer fixed to the said gripper becomes unstable, with the result that the spacer cannot perform its proper function.

The substrate of the faceplate having structural elements for fixing a spacer, such as the gripper above, may itself be structurally weakened by the fixing of the spacer to the gripper, thus leading to a possible danger of collapse.

SUMMARY OF THE INVENTION

The present invention has been made in an effort to solve the above problems.

The purpose of an embodiment of the present invention relates to providing a flat panel display having a faceplate, particularly to the faceplate constituting a flat panel display wherein spacers for maintaining uniform cell gap between substrates are mounted in the substrate of faceplate, the substrate of the faceplate having sufficient structural integrity to support the spacers.

According to the purpose of an embodiment of the present invention, a method is proposed for manufacturing flat panel displays by two steps. In the first step, multiple spacer-insert grooves are formed on one face of the substrate of the flat panel display. In the second step, spacers are inserted and fixed into the grooves.

According to the purpose of an embodiment of the present invention, a faceplate of flat panel display is proposed, the faceplate comprising multiple-anode electrodes having any randomly-shaped pattern and attached to one end-face of the faceplate substrate, characterized in that each end-side portions of multiple spacers are inserted into and fixed to multiple spacer-insert grooves formed in any random pattern between each anode electrode of the substrate.

According to the purpose of an embodiment of the present invention, there is also proposed a field emission display comprising a faceplate and backplate sealed to each other as part of a bag-like airtight seal, characterized in that the respective end-side portions of multiple spacers are inserted into spacer-insert grooves formed in any random pattern and attached to the faceplate, and the other end side portions thereof are supported by and positioned on the back plate.

According to the purpose of an embodiment of the present invention, there is additionally proposed a field emission display comprising a faceplate, faceplate-supporting substrate attached to one face of faceplate, and backplate sealed to each other with respect to the faceplate-supporting substrate, characterized in that one end side portions of multiple spacers are inserted into and fixed to spacer-insert grooves shaped in any pattern and formed in the substrate of the faceplate, the other end-side portions of multiple spacers being supported by and positioned on the backplate.

BRIEF DESCRIPTION OF THE DRAWINGS

The appended drawings, which are incorporated in and constitute a part of the specifications, illustrate an embodiment of the invention, and together with the description, serve to explain the principles of the invention.

DETAILED DESCRIPTION OF THE PREFERRED EMBODIMENTS

The preferred embodiment of the present invention is described with reference to attached drawings as follows.

Figure 1:
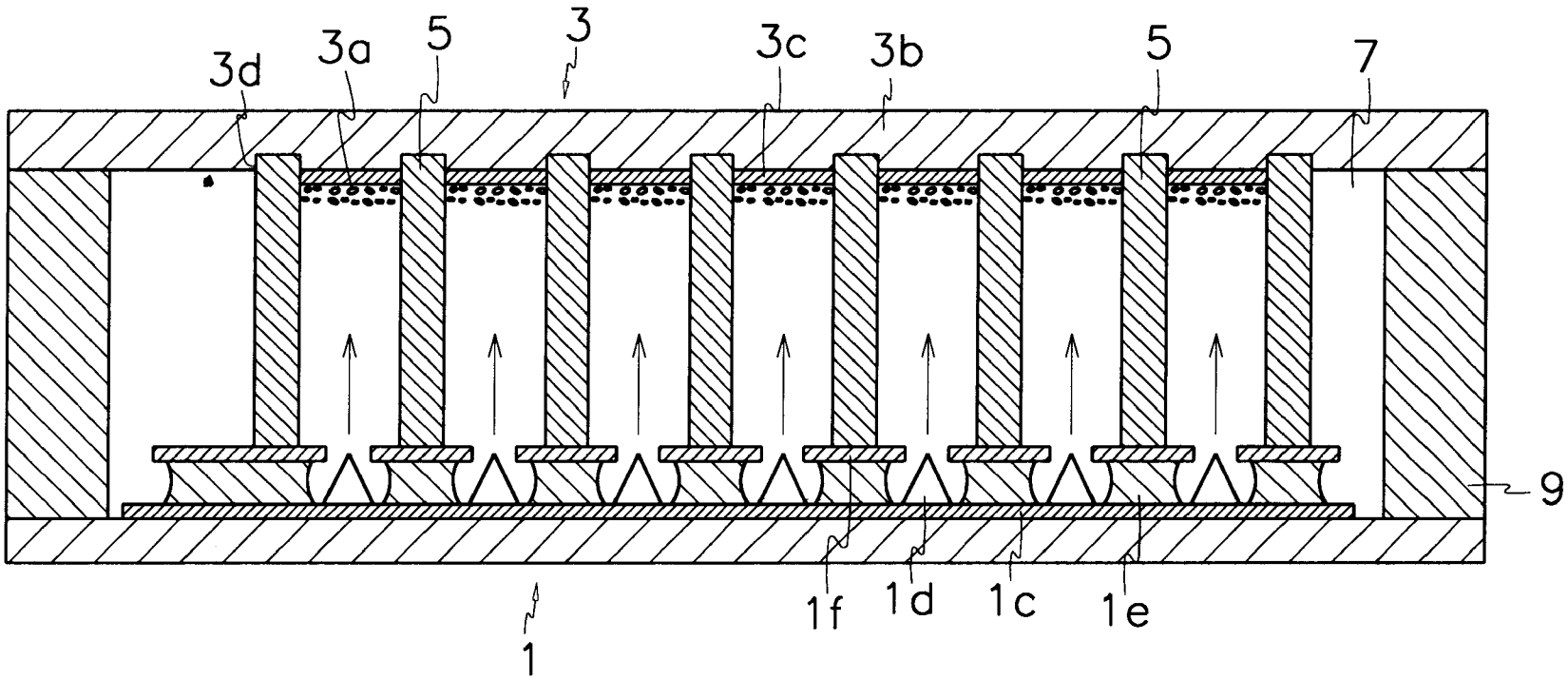
FIG. 1 is a cross-sectional view of a flat panel display according to the first embodiment of the present invention.

FIG. 1 is a cross-sectional view of a flat panel display according to a first embodiment of the present invention, the flat panel display, in this example, being an electrical field emission display.

The field emission display shown in the drawing, like a conventional field emission display, comprises a backplate 1 having negative poles Id which constitute the emitting field, a faceplate 3 having a fluorescent layer 3*a* which is spaced apart from and positioned in parallel with the backplate, and multiple spacers 5 for maintaining a uniform cell gap between both plates of the display.

The plates 1 and 3 are hermetically connected to side walls 9 between the plates, as part of a bag-like airtight seal, to keep the inner space 7 formed between the plates in a vacuum state.

According to an embodiment of the present invention, the backplate comprises one face of the substrate having multiple cathode electrodes 1*c*, negative poles 1*d* which constitute the emitting field, an insulating layer 1*e*, and grid electrodes 1*f* of any random pattern. The faceplate comprises one face of the substrate having multiple fluorescent layers 3*a* and anode electrodes 3*c* of some pattern.

The spacers 5 are placed in the inner space 7 with both ends supporting the two plates, i.e., the spacers 5 being placed in the inner space 7 such that one end of each spacer is inserted into a spacer-insert groove 3*d* formed on the substrate of the faceplate and the other end thereof is attached to a grid electrode if of the backplate 1.

Figure 2:
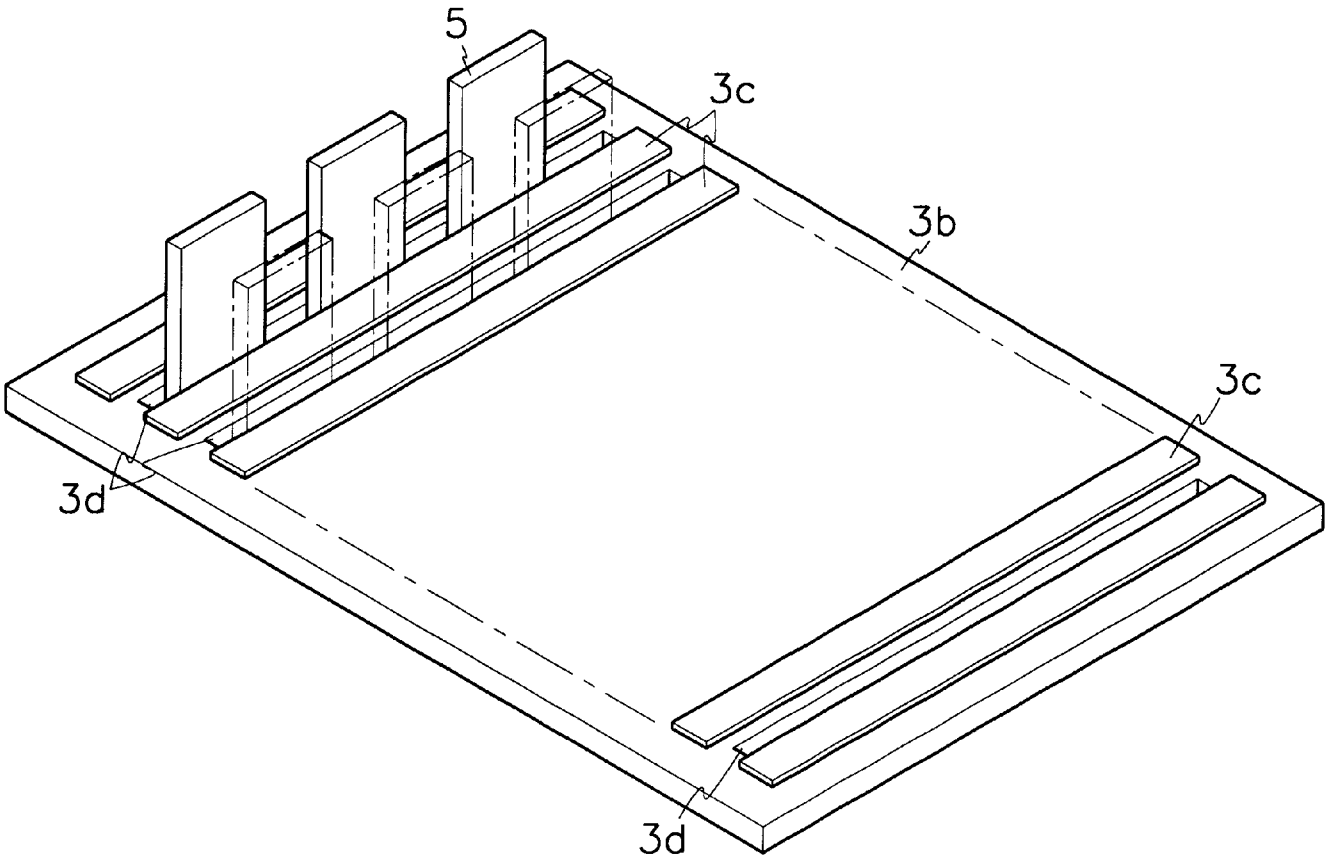
FIG. 2 is a layout view of the faceplate of a flat panel display according to the first embodiment of the present invention.
Figure 3A:
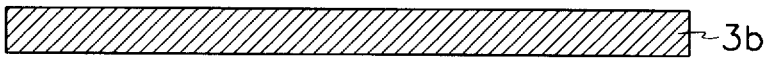
FIGS. 3A, 3B, 3C, 3D, 3E and 3F are layout views illustrating a process for forming spacer-insert grooves according to the first embodiment of the present invention.
Figure 3B:
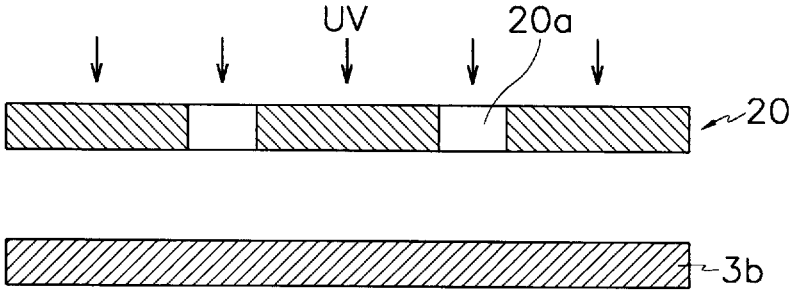
Figure 3C:
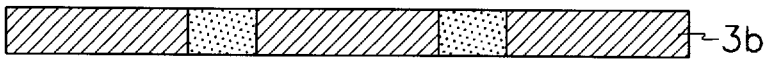
Figure 3D:
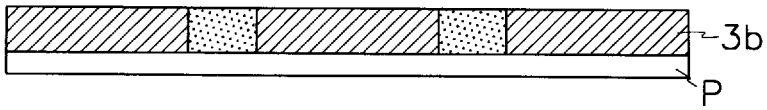
Figure 3E:
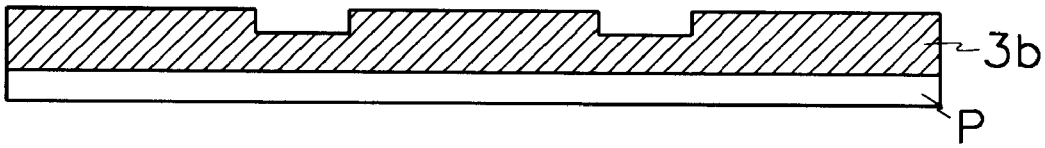
Figure 3F:
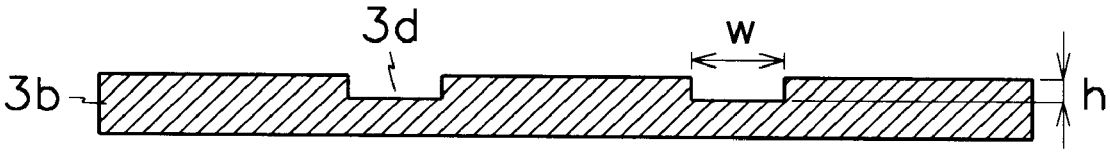

The spacer-insert grooves 3*d*, shown in more detail in FIG.2, are formed on the substrate 3*b* of the faceplate 3 in such a way that the grooves 3*d* are located in the spaces between the respective anode electrodes 3*c*.

According to the first embodiment of the present invention, the multiple anode electrodes 3*c* are formed at uniform space-intervals on the substrate 3*b*, therefore the spacer-insert grooves 3*b* are formed in parallel with and along the longitudinal direction of the anode electrodes 3*c*, and in an rectangular form of some width and height.

The spacers 5 fitted into the spacer-insert grooves 3*d* are shaped in a form of a thin-panel sheet and preferably made of such material as glass, glass-ceramic, and have a high aspect ratio required by flat panel displays and basic physio-chemical characteristics required for a spacer of a flat panel display.

According to the first embodiment, the field emission display is manufactured by fitting the spacers 5 into spacer-insert grooves 3*d* formed through the process described hereinafter.

FIGS. 3A, 3B, 3C, 3D, 3E, and 3F are outlined views illustrating the process comprising sequential steps whereby the spacer-insert grooves 3*d* are formed on the substrate 3*b* of a faceplate 3.

The process comprises the steps of:

(a) preparing the substrate 3*b* comprising photo-sensitive material such as photosensitive glass;

(b) placing on one face of the substrate 3*b* a mask 20 having multiple holes 20*a* formed in any pattern along the longitudinal direction;

(c) irradiating ultra violent light (UV) having a wavelength of 280–340 nm on the mask's hole pattern, with the result that an image of the hole pattern is formed on the substrate 3*b* with exposure of UV irradiated through the hole pattern 20*a;*

(d) etching the substrate 3*b* with etching solution of hydrofluoric acid (HF) so that it etches away the image portion, so that spacer-insert grooves 3*b* having predetermined width and height are formed;

(e) the above substrate goes through a heat treatment process in a high temperature calcining furnace, the heat treatment of the substrate being performed for an hour in a calcining furnace heated to around 500° C. and then another hour in a calcining heated to around 600° C.;

(f) after the above heat treatment process, a photoresist (P), an over-etching prevention substance, is applied to the entire other face of the above substrate (3*b*) and the photoresist (P) is used to prevent an over-etching of the hole pattern image area during the subsequent etching step;

(g) the spacer insert groove (3*d*) is formed through an etching process wherein some predetermined depth of the hole pattern image portion that is formed on one face of the substrate is etched away with an etching solution of HF; and;

(h) once the spacer insert groove (3*d*) is formed on the substrate (3*b*), the photoresist (P) is eliminated from the substrate (3*b*) and the substrate (3*b*) undergoes a polishing step to achieve its entire structural balance.

Through the above process, the spacer insert groove with a predetermined width (w) and height (h) is finally formed on the substrate.

Figure 4:
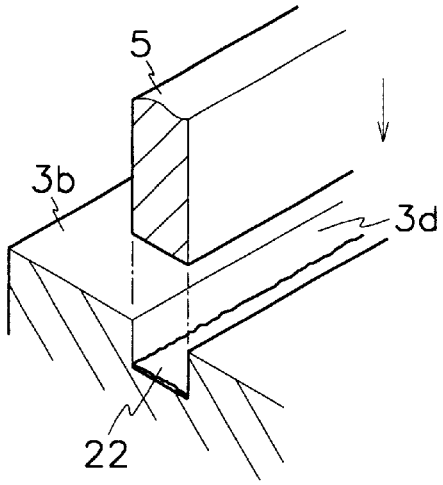
FIG. 4 is an enlarged view of a partial layout view illustrating a spacer being fitted into spacer-insert grooves according to the first embodiment of the present invention.

The spacer-insert grooves 3*d* formed on the substrate 3*b* in the above manner, whereinto one end of a spacer 5 is inserted for fixation, can strengthen the state of fixation with respect to a spacer 5 when the spacer 5 according to FIG. 4 is inserted into the spacer-insert grooves 3*d* whereto adhesives 22 such as glass frit or adhesive material have been applied.

Figure 5A:
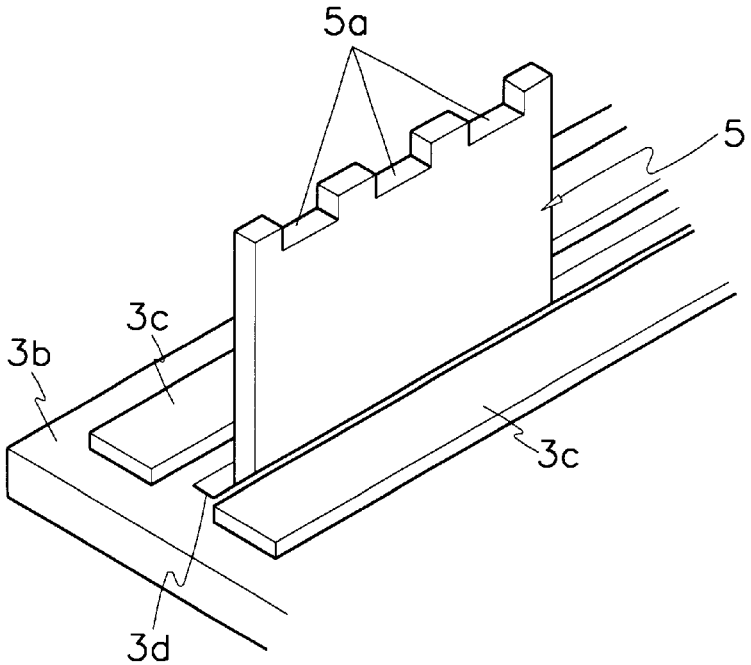
FIGS. 5A, 5B, and 5C are enlarged views of partial layout views illustrating a spacer fitted into a spacer-inserted groove according to the first embodiment of the present invention.
Figure 5B:
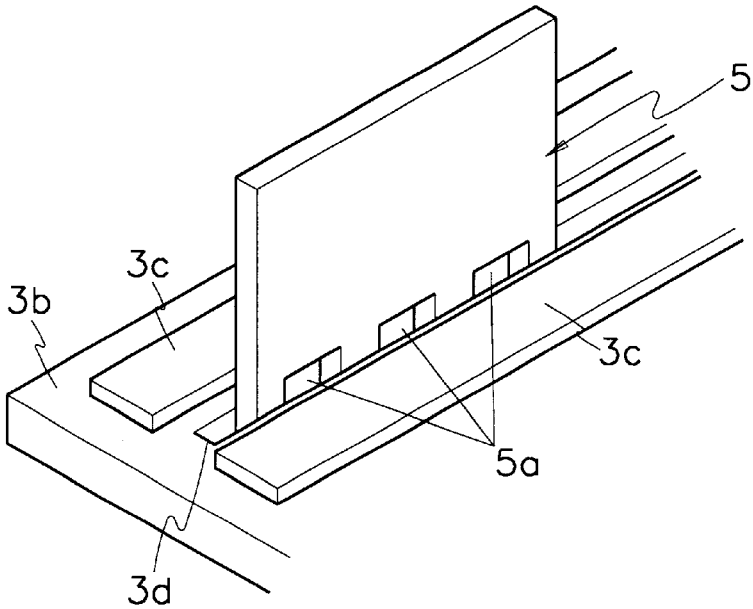

In the manufacturing process, the spacers 5 can be formed in a variety of shapes apart from the basic sheet shape, i.e., a spacer having multiple exhaust grooves 5*a* formed on one or both end-side portions of the spacer. In other words, the spacer 5 according to FIGS. 5A and 5B is either mounted in a way that one end-side portion of the spacer 5 having multiple exhaust grooves is fitted into the spacer-insert grooves or in another way that the other end-side portion not having multiple exhaust grooves is fitted into the grooves.

Figure 5C:
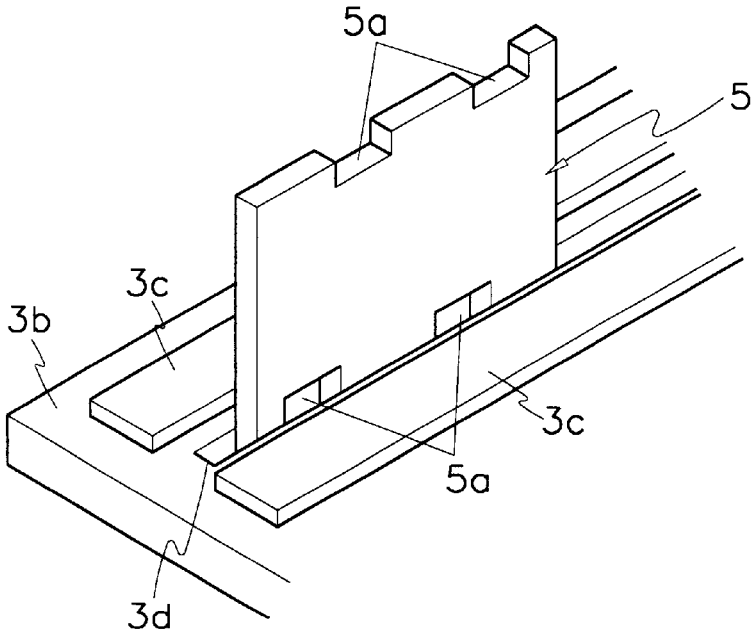

FIG. 5C proposes a spacer 5 of another shape having exhaust grooves 5*a* at both end-side portions of the spacer, wherein either of both end side portions of the spacer 5 of this type is fitted into the spacer-insert groove 3*d* of the substrate 3*b*.

When such modifications of the shape of the aforementioned spacers 5 are made by forming exhaust grooves 5*a*, the ventilation process of the field emission display can be enhanced. That is, during the process of ventilation of the inner space 7 between the two plates 1, 3, the aforementioned spacers 5 having exhaust grooves 5*a* reduce the spacer's resistance to the air exiting in the inner space 7 since it can flow through the exhaust grooves 5*a*.

As described hereinbefore, the present invention according to the first embodiment relates to a field emission display comprising a faceplate, wherein one end-side portions of sheetshaped spacers 5 are fitted into spacer-insert grooves 3*d* placed between anode electrodes 3*c*. The backplate is coupled to the faceplate through the spacers 5.

Figure 6:
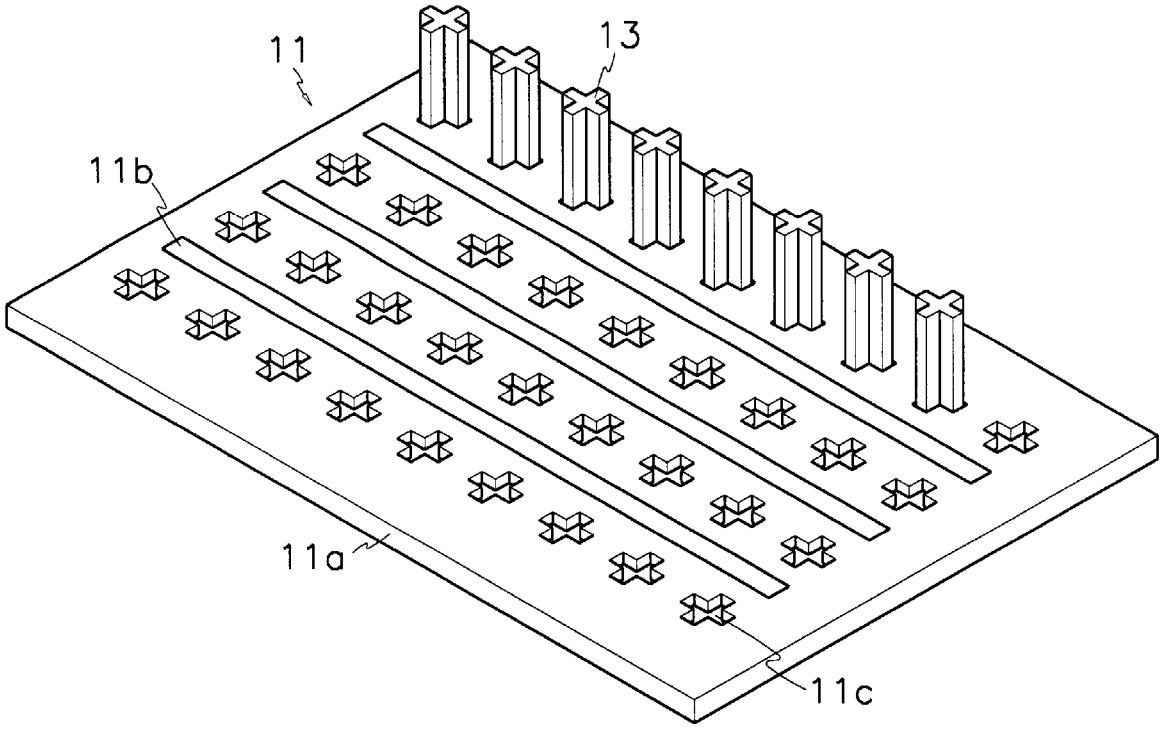
FIG. 6 is a layout view illustrating a faceplate of a flat panel display according to the second embodiment of the present invention.
Figure 7A:
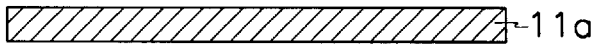
FIGS. 7A, 7B, 7C, 7D and 7E are layout views illustrating a process of forming spacer-insert grooves according to the second embodiment of the present invention.
Figure 7B:
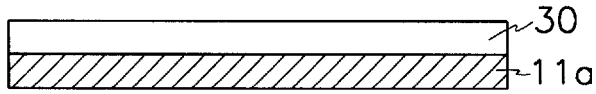
Figure 7C:
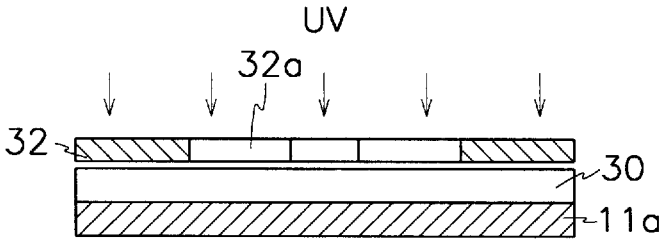
Figure 7D:
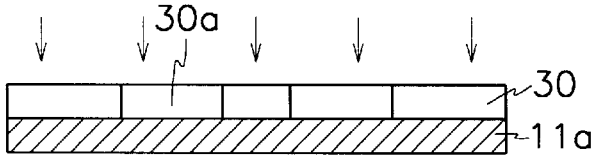
Figure 7E:
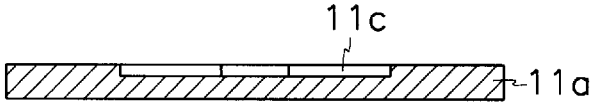

FIG. 6 is a layout view of the faceplate of a field emission display according to a second embodiment of the present invention. There is provided a faceplate 11, by way of example, the aforementioned faceplate, wherein one face of the substrate 11*a* comprises multiple anode electrodes 11*b* of any random pattern, and spacer-insert grooves 11*c* placed between each anode electrodes 11*b*. One end side portions of spacers 13 are inserted into the grooves 11*c*. The spacer-inserted grooves 11*c* are formed in a cross-shape and placed at some spaced interval along the longitudinal direction of the anode electrodes 11*b*. The spacers 13 are made as a pillared structure of a cross-shape pattern corresponding to the spacer-insert grooves 11*c*. The spacer-insert grooves 11*c*, according to the second embodiment, are formed on the substrate lha through the following process. FIGS. 7A, 7B, 7C, 7D, and 7E are step-by-step layout views of the process comprising the steps of:

(a) applying a Dry Film Resistor (DFR) 30 of a predetermined thickness on a substrate lha made of soda-lime glass, so that the dry film resistor is formed on the substrate 11*a* in a laminated manner, wherein the optimal speed and pressure of the roller for laminating, and the optimal temperature of the substrate 11*a* are essential to ensure that the dry film resistor may be laminated without foaming or creasing;

(b) applying to the laminated dry film resistor 30 a mask (32) having a perforated portion 32*a* corresponding to the pattern of the spacer-insert grooves 11*c*. In this present embodiment, the holes 32*a* are shaped in a cross-shape corresponding to those of the spacer-insert grooves 11*c;*

(c) performing a light-irradiating process wherein UV is irradiated on the dry film resistor, with the result that the dry film resistor 30 has a UV light-exposed portion corresponding to holes 32*a* of the mask 32.

(d) removing the UV light-exposed portion from the dry film resistor 30 by separating the mask 32 from dry film resistor 30 and developing the dry film resistor 30 with a developing solution, with the consequence that the dry film resistor 30 will have the same cross-shaped hole portion 32*a* as the mask 32; and (e) performing a sand blasting operation on the substrate 11*a* by using conventional means with the dry film resistor 30 used as a mask, so that the dry film resistor 30 left on the substrate 11*a* is exfoliated with an exfoliation solution, and thus spacer-insert grooves 11*c* are formed on the substrate 11*a*.

As described above, the second embodiment relates to a field-emission display having the same structure as the aforementioned display, the field emission display comprising a faceplate formed with steps comprising:

(a) forming spacer-insert grooves by means of sand blasting;

(b) inserting spacers 13 into said grooves; and (c) fixing the spacers 13 to the substrate of the faceplate, and further coupling a backplate to the faceplate 11.

Figure 8:
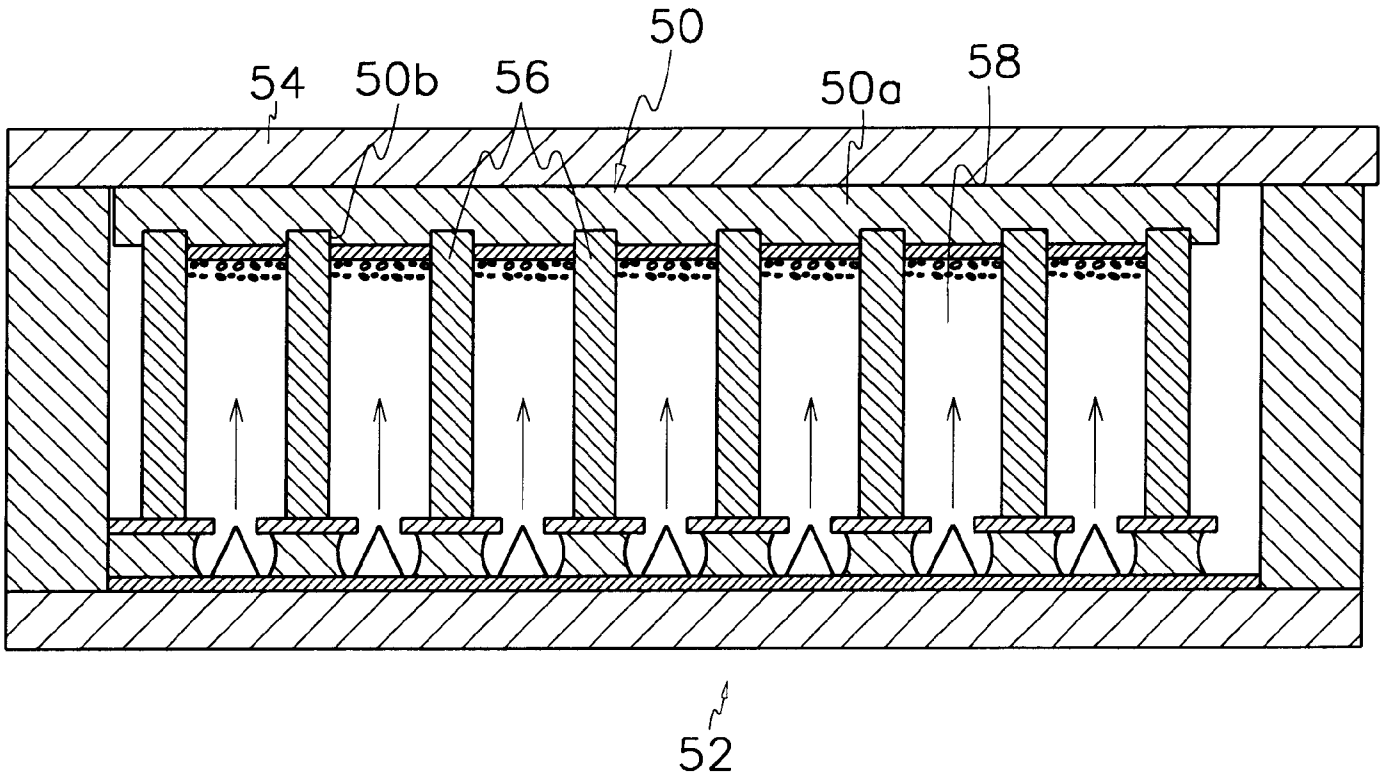
FIG.8 is a cross-sectional view of a flat panel display according to the third embodiment of the present invention.

Next there is provided a description of an field emission display according to a third embodiment of the present invention with reference to FIG. 8.

The illustrated electrical-emission display comprises such structure as to prevent cracks likely to occur on the faceplate when a spacer is connected to the substrate of faceplate previously described. That is, the field emission display, when faceplate 50 and backplate 52 are hermetically sealed, comprises such a sealed structure wherein the two plates 50 and 52 are not coupled to each other through the spacers 56 for making this seal, but rather a faceplate supporting substrate 54 attached to one face of the faceplate 50 and the backplate 52 are coupled for this seal.

Other structural features of the third embodiment of the present invention are identical to those of the field emission display of the first embodiment.

The field emission display, comprising an additional substrate 54 for supporting the faceplate 50, and wherein the spacers 56 are bonded to spacer-insert grooves 50*b* formed on the substrate 50*a* of the faceplate 50, can effectively prevent the cracking phenomenon likely to occur on the faceplate 50.

The reason is that the faceplate-supporting substrate 54 provides enough structural support to withstand the pressure imposed on the faceplate 52 while a vacuum is maintained within the inner space 58 of the field emission display.

As shown in the embodiments above, the spacers are disposed between the faceplate and backplate and strengthens the structure of the display wherein one end-portions of spacers are inserted into the faceplate and supported by the substrate of the faceplate.

Embodiments of the present invention can also include the spacer-insert grooves formed in other ways not described above, e.g, the groove can be made from a diamond wheel. That is, spacer-insert grooves formed in alternative methods corresponding to the pattern of spacer-insert grooves.

According to the embodiments described hereinbefore, the flat panel display comprises a field emission display, but the present invention can be applied to not only the field emission display, but also to other flat panel displays such as flat cathode ray tubes (CRTs).

Thus far the preferred embodiments of the present invention have been expounded. However the present invention, within the extent of what is claimed, specific description of the invention, and the scope of appended drawings, can relate to variations of the modified embodiments of variation, which are duly regarded as the present invention. Shown in the explanation about structure and workings of the present invention, the invention comprises spacers that provide structural support and are disposed between the faceplate and the backplate of a flat panel display.

Accordingly, the flat panel display according to the present invention has improved function that results from the stable alignment of spacers.

What is claimed is:

1. A method for manufacturing a flat panel display comprising the steps of:

(a) forming a plurality of spacer-insert grooves on one face of a substrate of said flat panel display, wherein the substrate comprises a photo sensitive material and the step of forming said spacer-insert grooves further comprises the steps of:

(1) placing a mask having a hole portion of a predetermined pattern on said substrate, (2) irradiating light on said substrate through said mask, (3) heat treating said substrate, (4) coating an opposite face of said substrate with an over-etching prevention material, (5) etching said substrate, and (6) eliminating said over-etching prevention material from said substrate; and (b) inserting and fixing at least one spacer into each of at least one of the spacer-insert grooves.

2. A method according to claim 1, wherein said heat treatment comprises a first heat treating process performed in a calcining furnace heated to approximately 500° C. and a second heat treating process performed in a calcining furnace heated to approximately 600° C.

3. A method according to claim 2, wherein each of said first and second heat processes is done for approximately one hour.

4. A method according to claim 1, wherein said over-etching prevention material comprises a photoresist.

5. A method according to claim 1, wherein said flat panel display comprises a field emission display.

6. A method according to claim 1, wherein said flat panel display comprises a faceplate comprising said substrate.

7. A method for manufacturing a flat panel display comprising the steps of:

(a) forming a plurality of spacer-insert grooves on one face of a substrate of said flat panel display, wherein the step of forming said spacer-insert grooves further comprises the steps of:

(1) applying dry film resistor layer on said substrate, (2) placing on said dry film resistor layer a mask having a predetermined hole pattern, (3) irradiating light through said mask on said dry film resistor layer and removing the light-irradiated portion of the dry film layer, and (4) sand blasting said portion of the substrate and removing a remaining portion of said dry film resistor layer from said substrate; and (b) inserting and fixing at least one spacer into each of at least one of the spacer-insert grooves.

8. A method according to claim 7, wherein said flat panel display comprises a field emission display.

9. A method according to claim 7, wherein said flat panel display comprises a faceplate comprising said substrate.

* * * * *